US006012773A

United States Patent [19]

Best

[11] Patent Number: 6,012,773

[45] Date of Patent: Jan. 11, 2000

[54] LECTURE DESK

[75] Inventor: Klaus Best, Neukirchen, Germany

[73] Assignee: Mauser Office GmbH, Korbach, Germany

[21] Appl. No.: 09/059,961

[22] Filed: Apr. 14, 1998

[30] Foreign Application Priority Data

Apr. 15, 1997 [DE] Germany ..... 197 15 637

[51] Int. Cl.[7] ..... A47B 39/00; A47C 15/00

[52] U.S. Cl. ..... 297/248; 297/160; 297/162; 297/170; 297/171; 297/173; 108/152; 108/49

[58] Field of Search ..... 297/248, 160, 297/162, 170, 171, 173, 174; 108/49, 152

[56] References Cited

U.S. PATENT DOCUMENTS

| | | | |
|---|---|---|---|
| 2,954,073 | 9/1960 | Junkunc | 297/162 Y |
| 3,159,425 | 12/1964 | Engstrom | 297/248 |
| 3,174,795 | 3/1965 | Chapman et al. | 297/248 X |
| 3,194,600 | 7/1965 | Junkunc | 297/248 X |
| 3,197,253 | 7/1965 | Brown | 297/162 X |
| 3,261,641 | 7/1966 | Black et al. | 297/162 |
| 3,265,436 | 8/1966 | Bombard et al. | 297/162 |
| 3,284,132 | 11/1966 | Chapman et al. | 297/162 |
| 3,368,842 | 2/1968 | Polsky | 297/162 |
| 3,497,262 | 2/1970 | Piretti et al. | 297/162 |
| 3,556,588 | 1/1971 | Monyer et al. | 297/162 |
| 3,614,157 | 10/1971 | Hendrickson et al. | 297/248 |
| 3,620,567 | 11/1971 | Hendrickson et al. | 297/248 |
| 3,680,911 | 8/1972 | Dupuis | 297/162 |
| 3,695,694 | 10/1972 | Mohr | 297/248 |
| 3,712,668 | 1/1973 | Fink | 297/162 |
| 3,784,249 | 1/1974 | Hendrickson et al. | 297/162 |
| 4,386,804 | 6/1983 | Ware et al. | 297/248 |
| 5,649,737 | 7/1997 | Behnke | 297/160 X |

FOREIGN PATENT DOCUMENTS 39 33 817 11/1990 Germany .

OTHER PUBLICATIONS

"Mehrzweckstuhle Serie 570" (Multipurpose Chair Series 570), Mauser Office GmbH, Korbach, Germany, 12 pages.

*Primary Examiner*—Peter M. Cuomo
*Assistant Examiner*—Rodney B. White
*Attorney, Agent, or Firm*—Herbert Dubno

[57] ABSTRACT

Stackable row chairs can be provided with desk assemblies for lecture hall purposes by forming a holder for the desk assembly with a pair of struts upon stirrups at their lower ends engaging the legs of the chair provided with the assembly. Connecting members can run from the stirrups to an adjoining chair to allow the desk assembly simultaneously to serve as a connecting system for joining the chairs in the row.

2 Claims, 7 Drawing Sheets

LECTURE DESK

FIELD OF THE INVENTION

My present invention relates to a lecture desk of the type in which a working platform or table is connected to a holding mechanism enabling it to be releasably mounted on a chair, especially a row-chair of the type having a row-forming mechanism for coupling each chair with an adjacent chair, particularly for use in auditoriums, lecture halls and the like.

BACKGROUND OF THE INVENTION

It is known to provide chairs, especially stackable chairs as described in the Mauser office brochure entitled "Mahrzweckstühle Serie 570" (Multipurpose Chair Series 570) of Mauser Office GmbH, Korbach, Germany, in which the chairs are described for auditoriums and the like which can be aligned in rows and connected together by coupling means between adjacent chairs. These chairs can be fitted with so-called lecture desks, i.e. a table carried by a mounting or holding mechanism enabling the table to be releasably attached to the chair so that the table is disposed just forwardly of the user and, ordinarily, on one side of the chair.

The lecture desk can be swung from a more or less horizontal position of use in which it is locked above the seating surface and forwardly of the user, into a substantially folded position alongside the seating service. The holding mechanism can, if desired, be attached to an armrest of the chair.

For assembling the chairs into rows for use in an auditorium or the like, the stackable chairs are removed from the stack, positioned side by side and connected together by appropriate coupling means. When the chairs are taken up from the rows, they can be stacked in a nested state so that space is conserved.

The coupling systems used for interconnecting the chairs in rows, are available in various configurations. For example, German patent 39 33 817 discloses a coupling system in which a stirrup is provided on the underside of the seating surface of one chair and hooks into a stirrup of the underside of an adjoining chair when these stirrups are extended toward one another. The free ends of the stirrups are formed with mutually-engaging hooks, A problem with this arrangement is that whether the chair is provided with or without an armrest, the lecture desk must be configured differently and different configurations of the couplings may have to be used.

Earlier desk systems have not proved to be effective for chairs which could be provided with or without armrests, are adapted to be coupled together or to be free-standing, or are especially configured for assembly in rows.

OBJECTS OF THE INVENTION

It is the principal object of the present invention to provide a lecture desk which can be mounted on a chair, can be affixed rapidly and securely to the chair and, in the case of need, can be simply and readily removed therefrom.

Another object of the invention is to provide a lecture desk attachment for a chair, especially a stackable chair, adapted to be connected with other chairs in a row to form a multiplicity of chair rows for a lecture hall, auditorium or the like, whereby drawbacks of earlier systems are obviated.

SUMMARY OF THE INVENTION

These objects are attained, in accordance with the invention by providing a support which is provided with a holding mechanism having at one end, the lecture-desk plate and at the other end, a strut arrangement which can clampingly engage the chair frame.

According to the invention, a plate forming the writing surface of the desk is swingably mounted on the holding unit which can comprise two struts connected in a V pattern and is clampingly engageable with the legs of the chair frame. The system of the invention allows its application to a row chair in an especially simple manner since a secure mounting of the desk can be assured with the clamping engagement of the struts with the legs of the chair and a plug connection between the chair and the struts in the form of a so-called pin-and-eye connection.

In a pin-and-eye connection, one of the members is provided with a pin while the other member is provided with an eye engageable by that pin. No screw or like threaded adjusting or engaging members are required and once the desk assembly is removed, the chair is restored to its ordinary function and can be connected in rows, provided with armrests or otherwise used conventionally in the formation of auditorium seating or stacked for storage. The desk assembly can be simply dropped into place on the chair frame and, without screw-type clamps which are time-consuming to operate, can be readily set up for lecture use. According to a further feature of the invention, one of the struts extends above the other strut and is provided at its upper end with a pivot for the platform extending perpendicular to the plane of the struts and a further axis at right angles to the first and lying in that plane.

The struts can be interconnected by a lug or bar which is provided with a pin or eye of the pin-and-eye connection mounting the assembly on the chair frame. More particularly, the lug can be formed with a slit or slot in which a correspondingly shaped pin is received. The other member of the pin-and-eye connection can be secured to the frame at the level of the seating surface.

The lower ends of the struts can be stirrups of a substantially U shape engaging over the legs of the chair and the stirrups can also act as carriers for members locking the chairs together in a row. These members can be hook elements elastically engaging the legs of adjacent chairs and connected to the stirrups at a front and back leg of a chair provided with the desk assembly. The hook elements can be welded to the stirrups and can be oriented in opposite directions, i.e. the front hook can be oriented in one direction (e.g. forwardly or rearwardly) and the rear hook oriented in the other.

In this manner, the stirrups which brace the struts on the frame of the chair provided with the desk can also be used to couple two chairs together, thereby giving a desk assembly a double function, namely serving as a writing platform and as a chair-coupling member. The chair-coupling elements are independent of the orientation of the writing platform and do not interfere with the swinging of the latter from the writing position into the inoperative position. Simply removing the desk assembly converts the chair back to standard stackability.

With the invention, utilizing resilient hook elements, i.e. spring-wire hooks, a certain stress can be provided between adjoining chairs, thereby imparting a stability to the chair rows which prevents dislocation of individual chairs form these rows, especially when the elastic hooks engage the front and rear legs of the adjoining chair in opposite directions as has been described. One hook is then turned forwardly while the other hook rearwardly.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
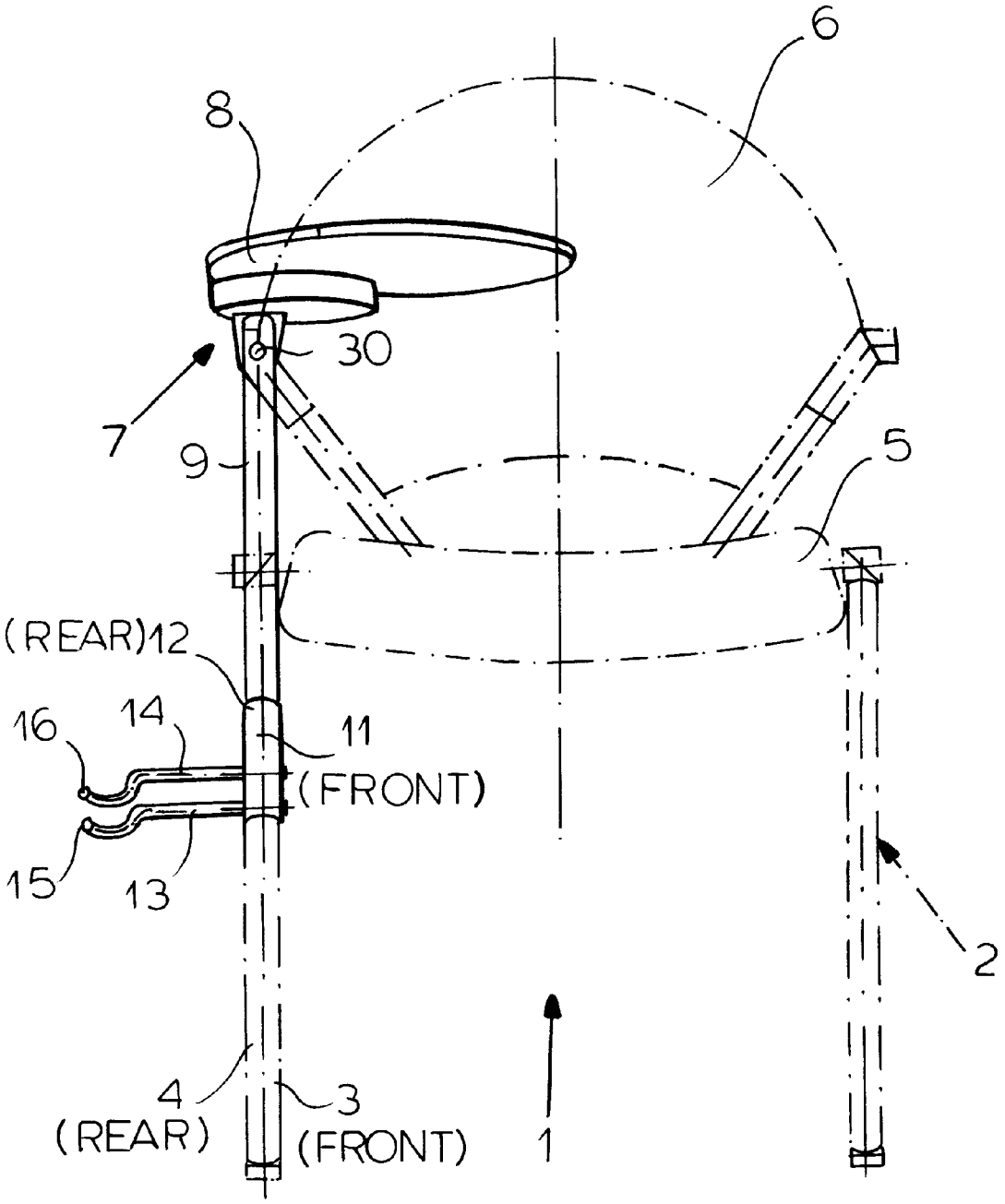
FIG. 1 is a front elevational view of a stackable row chair provided with a desk assembly according to the invention showing the writing platform in its operative position.

FIG. 1 shows a row chair 1 having the usual chair frame 2 with front legs 3 and rear legs 4. A seating surface 5 and a back rest 6 are provided on this frame.

According to the invention, a desk assembly 7 can be mounted on the chair and comprises a writing platform 8 which is connected by an articulation represented at generally 30 to the holder or holding mechanism 9. The desk assembly 7 is releasably mounted on the chair and may simply be dropped down upon it as will be apparent hereinafter.

Figure 4:
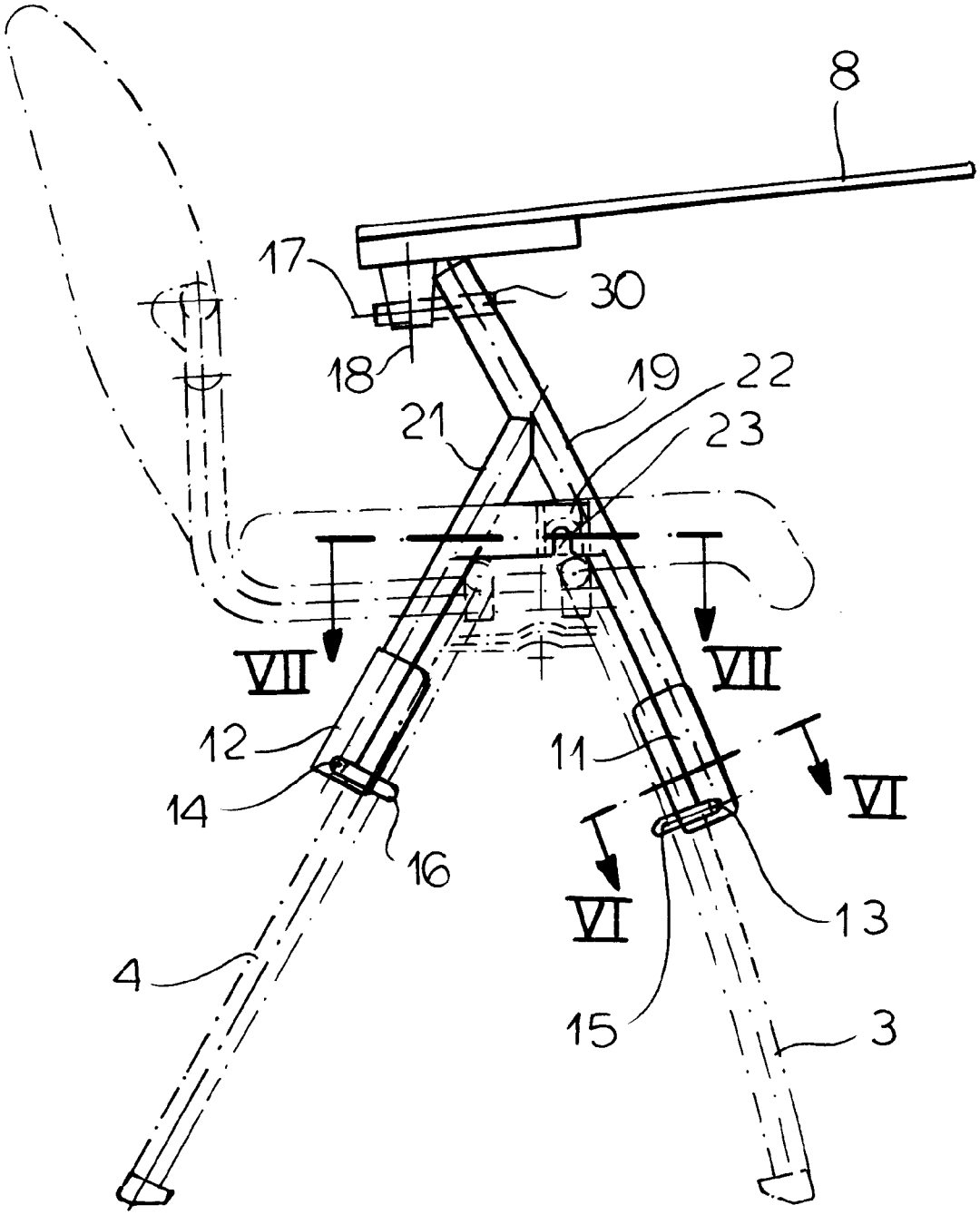
FIG. 4 is a side elevational view of the desk assembly of the invention.

The holder 9 comprises a pair of struts at the lower ends of which respective stirrups 11 and 12 are provided to engage over the front and rear legs 3 and 4 (see also FIG. 4).

Figure 6:
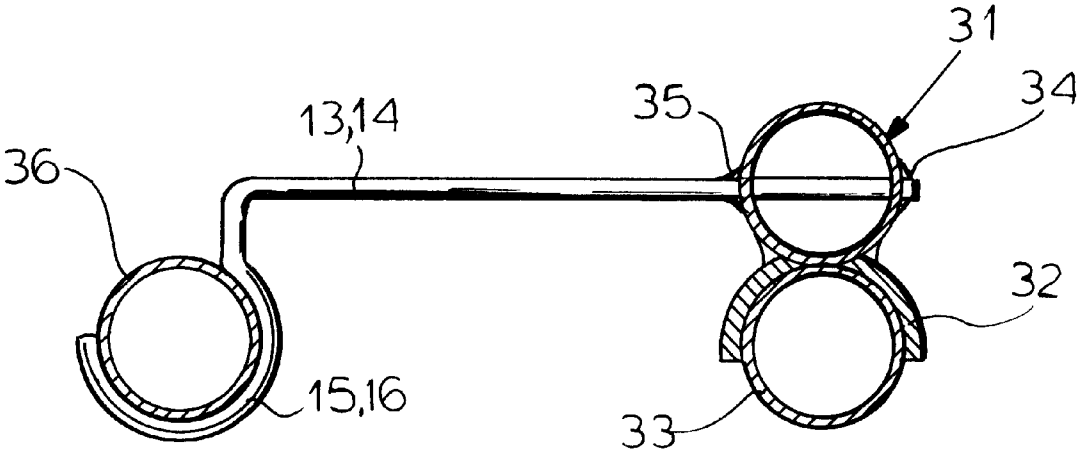
FIG. 6 is a cross sectional view taken along the line VI—VI of FIG. 4.

As can be seen from FIG. 6, each of the stirrups represented generically at 31 may have a U-shaped member engaging over the leg represented generically in FIG. 6 at 33. As will be described in greater detail, each stirrup may have a rod-shaped member 13 or 14 welded thereto at 34 and 35 and carrying a hook 15 or 16 as will be described. In FIG. 6 the hook is shown to engage a front or rear leg 36 of an adjoining chair.

Figure 1A:
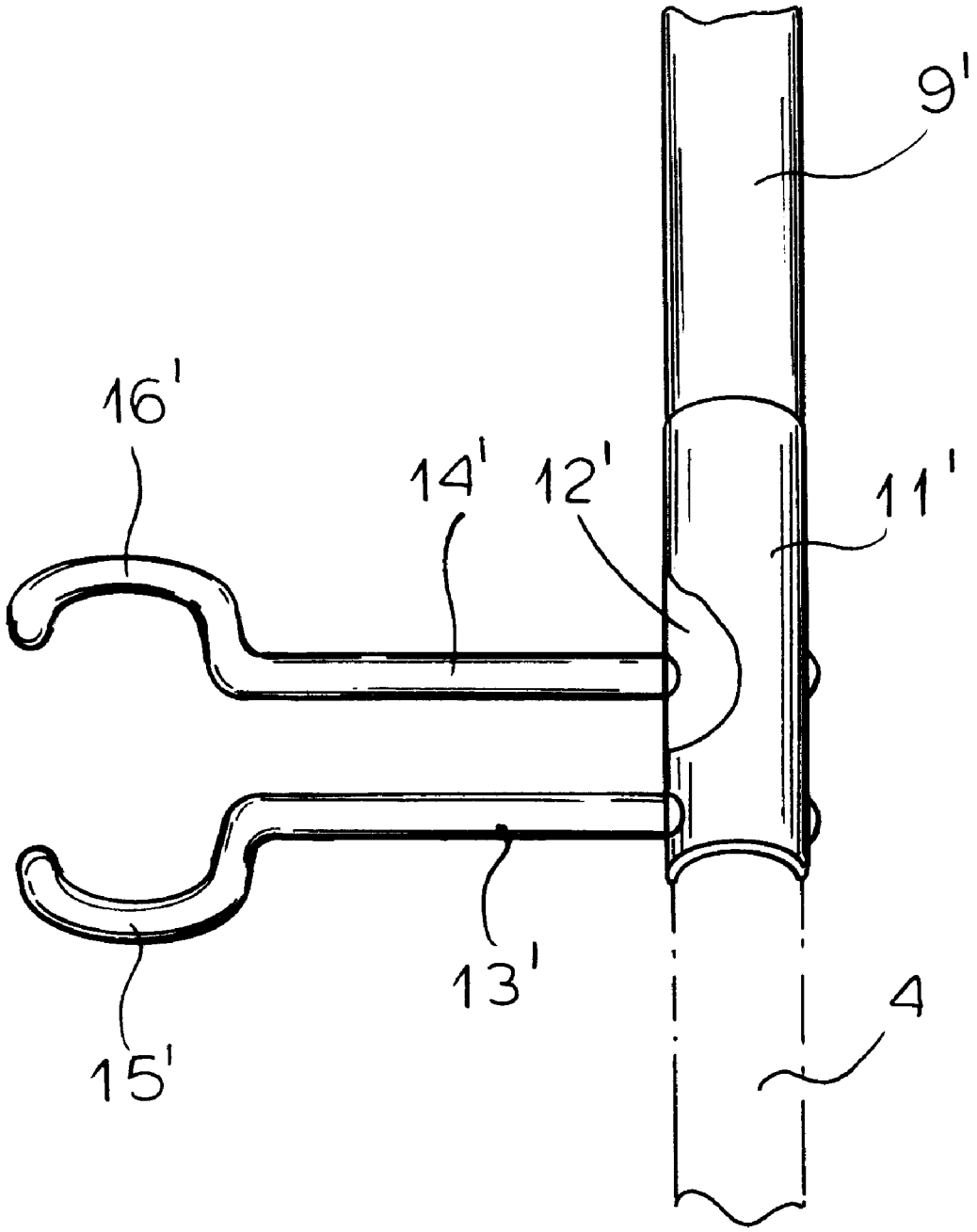
FIG. 1A is a detail showing oppositely turned hooks.

The rods 13 and 14 represent connecting elements which extend substantially horizontally downwardly from the respective stirrups 11 and 12 to engage an adjacent chair and thereby hold all of the chairs provided with such desks in a row. In FIG. 1A, the hooks 15', 16' (equivalent to hooks 15, 16) are turned in opposite directions and are formed on rods 13', 14' on the front stirrup 11' and the rear stirrup 12' of the holder 9'.

Figure 5:
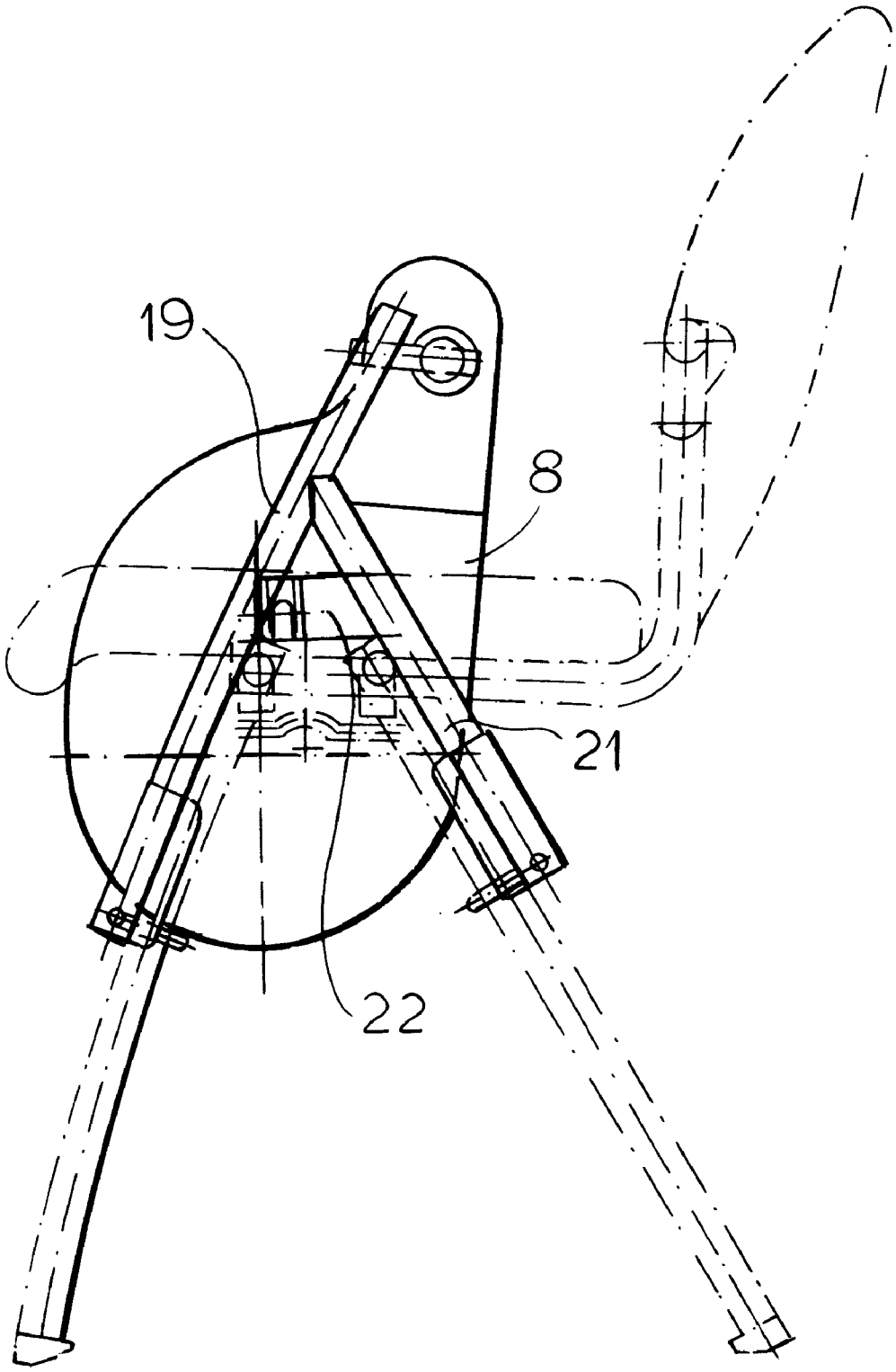
FIG. 5 is another side elevational view of the desk assembly with the writing platform folded into its inoperative position.

Further details of the desk assembly will be apparent from FIGS. 4 and 5.

Figure 2:
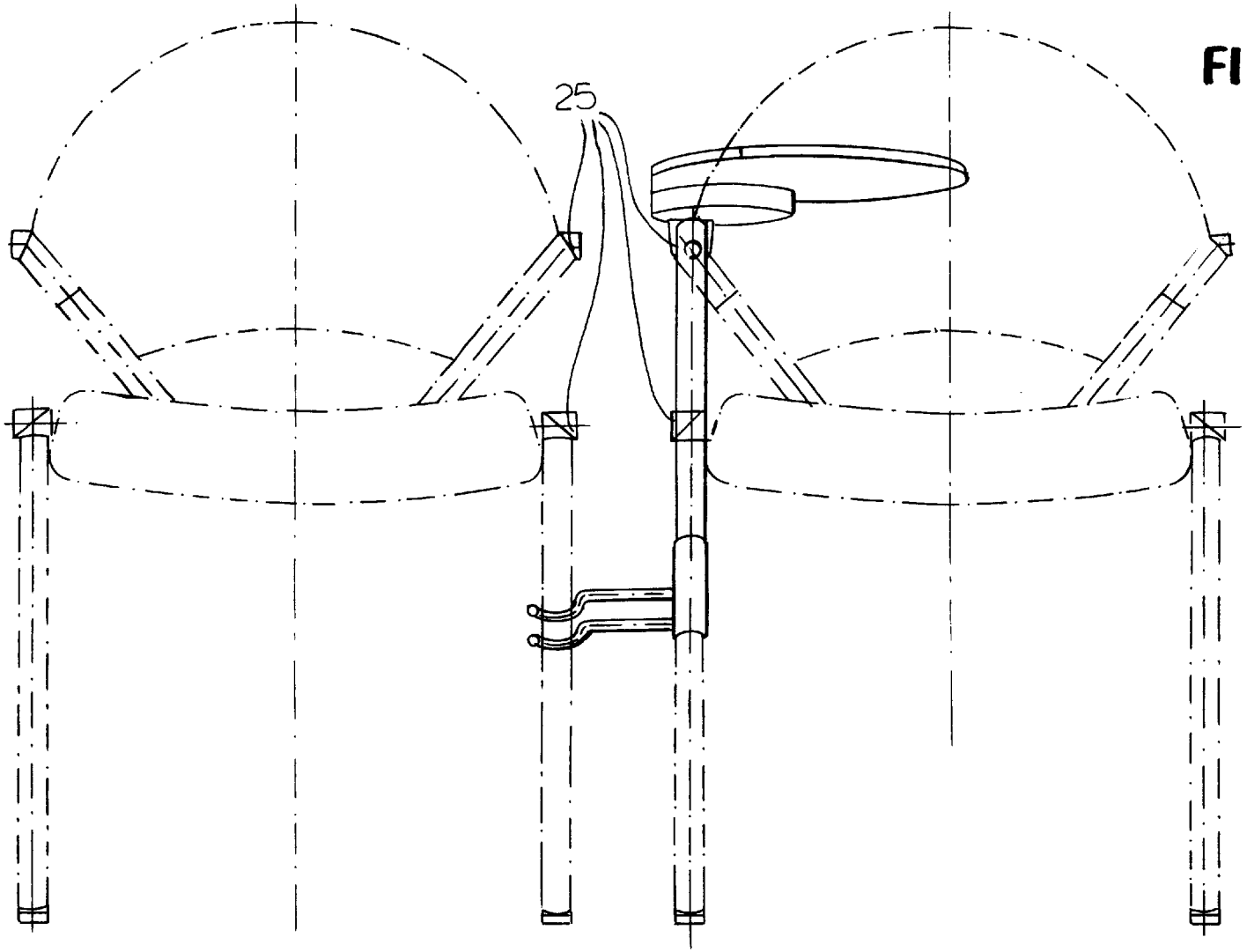
FIG. 2 is a view similar to FIG. 1 showing the chair provided with the desk assembly coupled to another chair in the row.

As can be seen from FIG. 2, the hooks 15 and 16 at the free ends of the connecting elements 13 and 14, can engage the front and rear legs of the adjoining chair (see also FIG. 3) with a clearance enabling the writing platform 8 to swing into the space between the chairs. Each desk thus has a dual function, serving both as a writing platform and work surface for a person sitting in the chair and as a connecting unit joining the chairs in the chair row.

Figure 3:
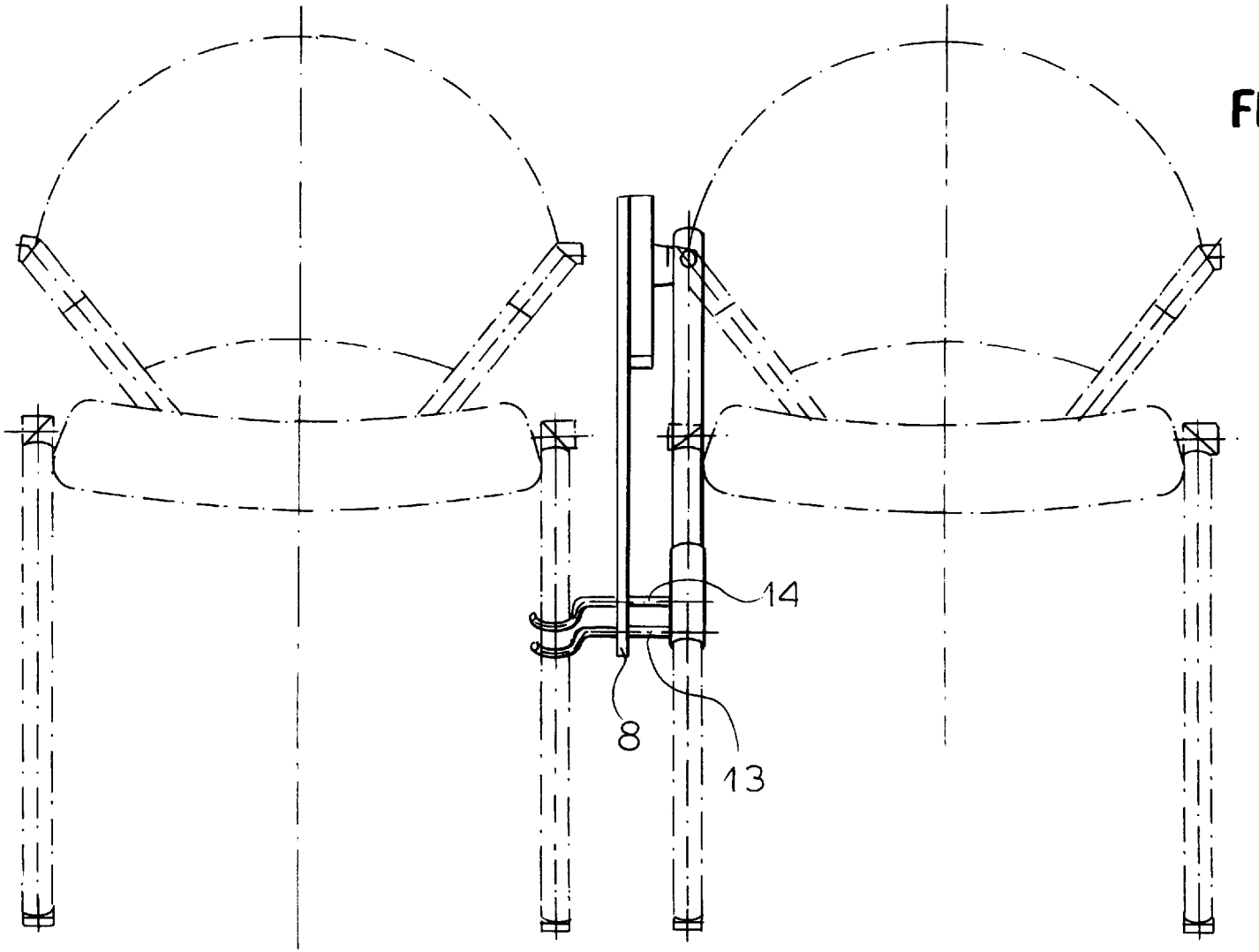
FIG. 3 is a view similar to FIG. 2 showing the writing platform in its inoperative downwardly folded position.
Figure 7:
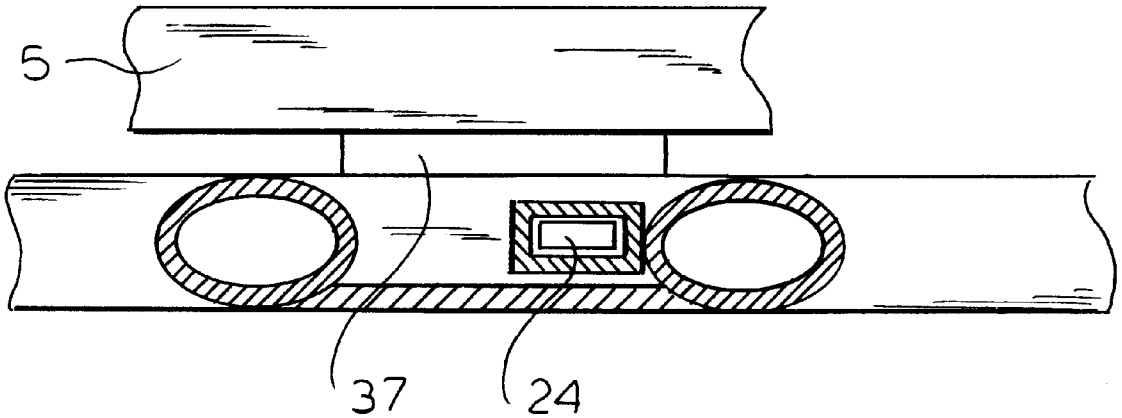
FIG. 7 is a cross-sectional view taken along the line VII—VII of FIG. 4 drawn to larger scale.

When the platform 8 is not in use, it can be swung into the position shown in FIGS. 3 and 5 and for this purpose, the articulation 30 can comprise a pair of mutually perpendicular axes (FIG. 4) including a substantially horizontal axis which is in the plane of the V formed by the support struts 19 and 21, and a vertical pivot axis 18 which is perpendicular to the pivot axis 17. As will be apparent especially from FIGS. 4 and 5, the struts 19 and 21 are connected by a bar or lug 22 which is formed at its bottom with a slit 23 into which a coupling element 24, namely, a pin, can extend. The pin is mounted on a bracket 37 below the seating surface 5 and on the frame previously described (compare FIG. 7).

Additional coupling elements can be fitted into socket 25 which can form pin-and-eye connections for the adjacent seats when the desk assembly is not used.

FIG. 1A also indicates that the hooks 15' and 16' of each desk can be oriented in opposite directions, i.e. one hook will engage one leg of an adjoining chair in one direction while the other hook engages the other leg of the adjoining chair in the opposite direction, i.e. one is turned forwardly while the other is turned rearwardly, so that a certain degree of stress is provided between the connecting elements 13', 14', 15', 16" which are elastically deformed in fitting the hooks against the respective legs.

I claim:

1. A desk assembly comprising:

a chair having a seating surface on a chair frame with downwardly diverging legs in respective planes on opposite sides of the seating surface and wherein a front leg and a rear leg of the frame at one side of the chair lie in a plane and are bridged by a bracket from which a holding element projects laterally, said chair being one of two chairs connected by said holding element; and a desk mounted on said one side and comprising:

a pair of support struts adjoining at a vertex in a V and lying in said plane of said front and rear legs at said one side, said support struts having lower free ends formed with stirrups receiving said front leg and said rear leg, respectively, one of said struts extending upwardly beyond said vertex to an upper end;

respective connecting elements extending from said stirrups and formed with hooks for engagement with legs of an adjoining chair and defining a gap between said struts and said adjoining chair;

an articulation formed on said upper end of said one of said struts;

a writing platform mounted on said articulation and swingable between an operative generally horizontal writing position and an inoperative generally vertical position wherein said platform lies in said gap; and a bar interconnecting said struts in said plane below said vertex and formed with a slot receiving the holding element of the chair on which said desk assembly is mounted.

2. The desk assembly defined in claim 1 wherein said hooks are turned in the same direction.

* * * * *